US007422123B2

(12) United States Patent
Zerza et al.

(10) Patent No.: US 7,422,123 B2
(45) Date of Patent: Sep. 9, 2008

(54) CRANE BOOM FOR TRANSPORT AS CONTAINER FREIGHT AND A TRANSPORT APPARATUS FOR TRANSPORT OF THE BOOM PARTS OF A CRANE BOOM OF THIS TYPE

(75) Inventors: Horst Zerza, Biberach/Riss (DE); Joachim Mayer, Biberach/Riss (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 76 days.

(21) Appl. No.: 11/225,718

(22) Filed: Nov. 25, 2005

(65) Prior Publication Data

US 2006/0118506 A1 Jun. 8, 2006

(30) Foreign Application Priority Data

Sep. 13, 2004 (DE) ..... 10 2004 044 182

(51) Int. Cl.
*B66C 23/70* (2006.01)

(52) U.S. Cl. ..... 212/177

(58) Field of Classification Search ..... 212/177
See application file for complete search history.

(56) References Cited

U.S. PATENT DOCUMENTS 4,016,974 A * 4/1977 Tax ..... 206/321
6,439,408 B1 * 8/2002 Aquino et al. ..... 212/297

FOREIGN PATENT DOCUMENTS

| | | |
|---|---|---|
| DE | 1 279 904 | 4/1967 |
| DE | 2453166 | 5/1976 |
| DE | 2525844 | 9/1976 |
| DE | 31 05 771 A1 * | 2/1981 |
| DE | 2931422 | 2/1981 |
| DE | 2934176 | 3/1981 |
| DE | 29718157 | 2/1998 |
| DE | 20205223 | 8/2003 |

* cited by examiner

*Primary Examiner*—Thomas J. Brahan
(74) *Attorney, Agent, or Firm*—Dilworth & Barrese LLP

(57) ABSTRACT

The present invention relates to a crane boom for transport as container freight which can be assembled from a plurality of boom parts which each have coupling pieces at the front face end for the putting together of the boom parts, wherein the boom parts each have at least one bottom chord and can be placed next to one another such that the bottom chords of the boom parts together form a continuous runway free of offset and faults for a crab. The invention further relates to a transport apparatus for the transport of boom parts of a crane boom of this type as container freight. In accordance with the invention, the boom parts of the crane boom, despite the identical bottom chord track dimensions which provide a runway for a normal crab on the bottom chords largely free of offset and faults, have different cross-sections such that the boom parts can be pushed into one another for the purpose of transport, whereby the space in the boom parts is also utilized.

20 Claims, 5 Drawing Sheets

CRANE BOOM FOR TRANSPORT AS CONTAINER FREIGHT AND A TRANSPORT APPARATUS FOR TRANSPORT OF THE BOOM PARTS OF A CRANE BOOM OF THIS TYPE

BACKGROUND OF THE INVENTION

The present invention relates to a crane boom for transport as container freight which can be assembled from a plurality of boom parts which each have coupling pieces at the front-face end for the putting together of the boom parts, with the boom parts each having at least one bottom chord and being able to be put together such that the bottom chords of the boom parts together form a runway for a crab which is continuously free of misalignment and faults. The invention further relates to a transport apparatus for the transport of boom parts of a crane boom of this type as container freight. The invention finally relates to a container unit consisting of the boom parts of the crane boom and of a transport apparatus of this type.

The transport volume also plays a substantial role with cranes to be shipped due to the constantly increasing transport costs. As a rule, crane booms of tower cranes which commonly reach boom lengths of over 60 m are particularly bulky. Crane booms of this type of tower cranes, as a rule, have system similarity over the total boom length so that they can only be transported in a space-saving manner with difficulty.

A reduction in the transport volume and greater space utilization can be achieved with a telescopic boom in which the boom parts can be telescoped together.

Telescopic booms of this type, however, make a special crab shape necessary since the boom parts have to work with different bottom chord tracks for the crab in crane operation or have bottom chords offset in height to permit a pushing together. Telescopic booms of this type are relatively expensive. It is additionally necessary to design the construction of the crab such that it can either travel over the vertical faults or over the track width offset between the bottom chords of different boom parts.

In contrast, crane booms can be manufactured much more simply and also at a more favorable cost in which the boom parts can be put together sequentially by means of coupling pieces provided at the front face end. With crane booms of this type, the boom parts can be joined together such that the bottom chords connect to one another without offset or fault and a runway for the crab of the crane is formed beyond the intersection points between the boom parts which is continuously substantially free of offset or faults. However, the problem arises with crane booms of this type of being able to transport them in a space-saving manner since the boom parts correspond to one another as a rule so that they can only be placed next to one another. It is, however, hereby impossible to pack a crane boom in a standardized 40-foot container. As a rule, a plurality of containers have to be used or a plurality of transports carried out for the shipping of a crane boom.

SUMMARY OF THE INVENTION

It is therefore the underlying object of the present invention to provide a crane boom of the type initially named as well as a transport apparatus for the transport of the boom parts of a crane boom of this type which avoid the disadvantages of the prior art and to further develop the latter in an advantageous manner. A space-saving transport of the crane boom as container freight should preferably be made possible.

This object is solved by a crane boom and transport apparatus having the features herein.

In accordance with the invention, the boom parts of the crane boom, despite having identical bottom chord track dimensions which provide a runway for a normal crab on the bottom chords which is largely free of offset and faults, therefore have cross-sections which are so different that the boom parts can be pushed into one another for the purpose of transport, whereby the space in the boom parts is also used. At least one of the boom parts can, in the state pushed into one another, advantageously additionally be connected to a pair of transport frames which each have external container connectors compatible with standard containers. In accordance with the invention, the said transport frames do not only have the external connectors compatible with containers, but also connection elements for connection to the one boom part. The connection elements are in particular made such that they are connectable to the end face coupling pieces of the corresponding boom part which actually serve the putting together of the boom parts to form the crane boom. The transport frames so-to-say bridge the connection dimensions of the boom parts to the external connector dimensions of standard containers. In accordance with the invention, a container unit is provided which consists, on the one hand, of the crane boom or of its boom parts and, on the other hand, of the two transport frames, with the transport frames being assembled at the end face at at least one boom part, preferably at two boom parts arranged next to one another into which the further boom parts of the crane are pushed. This container unit forms a wall-free container which is self-supporting due to the boom part or the boom parts connected to the transport frame.

To utilize the usual dimensions of a standardized 40-foot container in the best possible manner, the transport frames each have two sets of connection elements arranged next to one another with the help of which two boom parts arranged next to one another longitudinally can be fastened to the transport frame by their coupling pieces. The remaining boom parts of the crane boom, which have a correspondingly reduced cross-section, can advantageously be pushed into these two boom parts.

To stiffen the transport frame sufficiently, the four frame limbs assembled to form a closed rigid section can advantageously be stiffened by at least one diagonal strut.

The boom parts of the crane boom can have different cross-section geometries. In accordance with a first advantageous embodiment of the invention, all boom parts can each have two bottom chords which are made with identical track dimensions so that, in the assembled state of the boom parts, two runways respectively free of offset or faults are formed for the wheels of a crab. A first group of boom parts in this case has at least two top chords, whereas a second group of boom parts only has one top chord.

In accordance with a second advantageous embodiment of the invention, all boom parts can also each have only one bottom chord so that the wheels of the crab only travel on the only one bottom chord of the boom parts, which can, however, likewise be assembled such that a continuous runway free of offset and faults is formed. In this case, the boom parts preferably have a plurality of top chords arranged in different track dimensions.

The cross-section differences between the boom parts can be matched to the respective boom length and to the number of boom parts into which the crane boom is divided. It would generally be possible to provide the boom parts with cross-sections graduated such that the boom parts can each be pushed into one another in the manner of a telescope system for the purpose of transport. However, a better space utilization for the format of a standardized 40-foot container results in that the boom parts are made with cross-sections so different that two boom parts with a smaller cross-section can be pushed next to one another into a boom part with a larger cross-section. It is hereby possible still to make the crane boom with relative system similarity. Two boom parts with a larger, identical cross-section can be made lying next to one another between the transport frames and receive up to four boom parts with smaller cross-sections each identical to one another.

The boom parts can be pushed into one another in a particularly space-saving manner when different boom parts have a different number of longitudinal chords. In accordance with an embodiment of the invention, at least one boom part can be made as a three-chord carrier, whereas at least one other boom part is made as a four-chord carrier or as a multi-chord carrier. The four-chord carrier expediently has the larger cross-section so that the three-chord carrier can be pushed into the four-chord carrier.

To be able to optimally utilize the space in the four-chord carrier and to be able to use a crab customary per se which engages around the bottom chords from the outside, the at least one boom part with the at least four longitudinal chords can have two lateral diagonal bracings which are arranged spread open in a V shape from the bottom chords to the top chords, i.e. the diagonal bracings each extend inwardly from the top to the bottom. The bottom chord thus remains free to be traveled on by a crab, whereas simultaneously the inner cross-section remains as large as possible to be able to push in the other boom parts.

The boom parts are expediently arranged with the fewer longitudinal chords toward the boom tip, whereas the boom parts with the more longitudinal chords are arranged toward the lower end of the boom. Two four-chord carriers can in particular be arranged at the lower end of the boom and can be supplemented by a plurality of three-chord carriers toward the tip of the boom. It is, however, understood that different divisions and arrangements are generally possible.

To achieve a sufficient stiffness of the crane boom, the boom parts with only three longitudinal chords arranged toward the tip of the boom can be guyed by a guying at the boom parts disposed further inwardly and/or at a tower top of a tower crane. The crane boom can generally be made as a guyed crane boom, with the guying of the outwardly disposed boom parts in this case being guided toward the tower top. Alternatively, the crane boom can, however, also be made as a purely flexure beam boom. The guying is in this case guided to the further inwardly disposed boom parts.

To be able to securely arrange the boom parts with smaller cross-sections in the boom parts with larger cross-sections, fastening means are advantageously provided for the fastening of the inserted boom parts to the outwardly disposed boom parts with larger cross-sections. It would generally also be possible also to fasten the inserted boom parts toward the frame parts. The fastening to the outer boom parts is, however, in particular advantageous when the inserted boom parts have a smaller length than the outwardly disposed boom parts with larger cross-sections.

BRIEF DESCRIPTION OF THE DRAWINGS

The invention will be explained in more detail in the following with respect to a preferred embodiment and to associated drawings. There are shown in the drawings.

DESCRIPTION OF THE PREFERRED EMBODIMENTS

Figure 1:
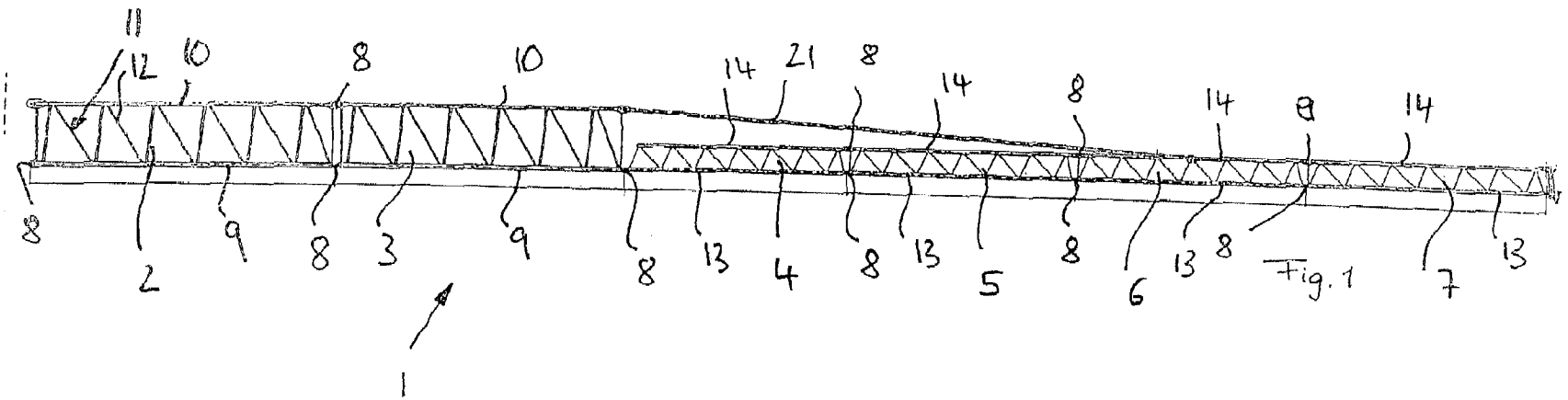
FIG. 1: a side view of a crane boom for a tower crane in accordance with a preferred embodiment of the invention.

The crane boom 1 of a tower crane drawn in FIG. 1 is assembled from a plurality of boom parts, in the embodiment drawn six boom parts 2 to 7. It is, however, understood that the crane boom can be assembled from more or less than six boom parts. It is in particular possible to configure the crane boom in accordance with the desired boom length by the insertion of additional or the removal of individual boom parts. The boom parts 2 to 7 each include coupling pieces 8 arranged on the end face with the help of which the boom parts 2 to 7 can be put together in the manner of a chain and connected to one another. The coupling pieces 8 can be made in a customary manner as plugged bolt connections. As FIG. 1 shows, the boom parts 2 to 7 are each made as lattice carriers.

In the embodiment drawn, two groups of boom parts 2, 3 and 4 to 7 are provided which differ from one another by the number of their longitudinal chords and by their cross-sectional shapes, with the boom parts being made substantially identical to one another within each group. To be able to push the boom parts into one another in a space-saving manner and to be able to arrange them for transport, depending on the design of the crane boom, more than two groups of boom parts can also be provided. The formation of the boom parts in two groups, however, brings about a higher system similarity.

Figure 4:
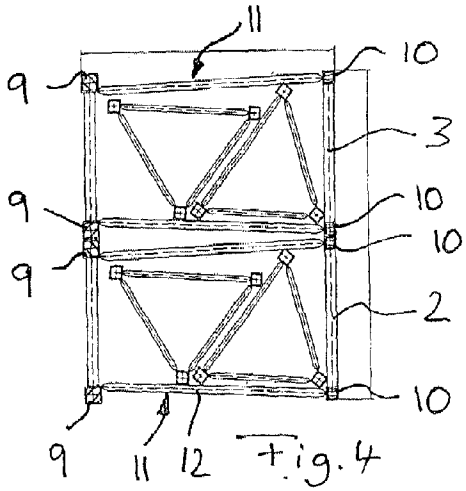
FIG. 4: an end face view of the boom parts of FIG. 3 packed together for transport.
Figure 2:
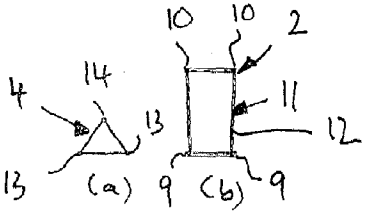
FIG. 2: end face views of the boom parts of the crane boom of FIG. 1 which show the different cross-section shapes of the boom parts.

The first two boom parts 2, 3 forming the first group of boom parts are arranged at the lower end of the boom and have a larger cross-section than the boom parts 4 to 7 of the second group of boom parts arranged toward the tip of the boom. As FIG. 4 shows, the two larger boom parts 2 and 3 each have four longitudinal chords, and indeed in each case two bottom chords 9 and two top chords 10 which are arranged at the corners of a rectangle. As FIG. 4 shows, the top chords 10 with the bottom chords 9 are connected to one another by two transverse bracings 11 of lattice struts 12, with the transverse bracings 11 extending inwardly from top to bottom, i.e. the articulated points of the lattice struts 12 are inwardly offset at the bottom chords 9 so that the upper sides of the bottom chords 9 remain free and respectively form a runway for a crab (not shown in more detail) of the crane.

The boom parts 4 to 7 of the second group of boom parts are each made as three-chord carriers. They each have two bottom chords 13 and a top chord 14, with the bottom chords 13 being made with identical track dimensions to the bottom chords 9 of the boom parts 2 and 3. In the assembled state of the boom parts, as FIG. 1 shows it, the upper sides of all bottom chords 9 and 13 of the boom parts 2 to 7 are free of offset and faults with respect to one another so that a continuous runway free of offset and faults is formed for the wheels of the crab.

The lengths of the two larger boom parts 2 and 3 are identical to one another. The lengths of the outer boom parts 4 to 7 are each smaller than the length of the boom parts 2 and 3. In addition, the cross-sections of the outer boom parts 4 to 7 are dimensioned such that two respective boom parts 4, 5 or 6, 7 can be pushed into one of the larger boom parts 2 or 3 in a manner disposed next to one another. The boom parts 4 to 7 made as three-chord carriers are rotated for this purpose about their longitudinal axis with respect to the assembled state so that the width or the spacing of the bottom chords 13 from one another, which corresponds to the bottom chords 9 of the larger boom parts 2 and 3, is not disturbing. In this process, the angled arrangement of the transverse bracings 11 of the larger boom parts 2 and 3 is advantageous, as FIG. 4 shows.

Figure 5:
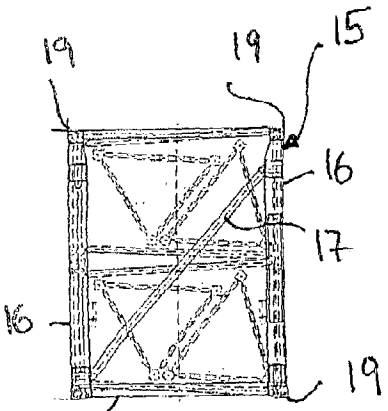
FIG. 5: an end face view of the boom parts of FIG. 3 packed together for transport with attached transport frames which shows the arrangement of a transport frame at the boom parts at the end face side.

For the purpose of transport, transport frames 15 are mounted at the end face in each case at the coupling pieces 8 of the two boom parts 2 and 3 of larger cross-section disposed next to one another and substantially consist, as FIG. 5 shows, of four frame limbs 16 which are assembled to form a closed, rigid frame and which are stiffened by a diagonal strut 17. The transport frames 16 each have two sets of connection elements 18 with the help of which they can be fastened to the coupling pieces 8 of the two boom parts 2 and 3 disposed over or next to one another.

Figure 3:
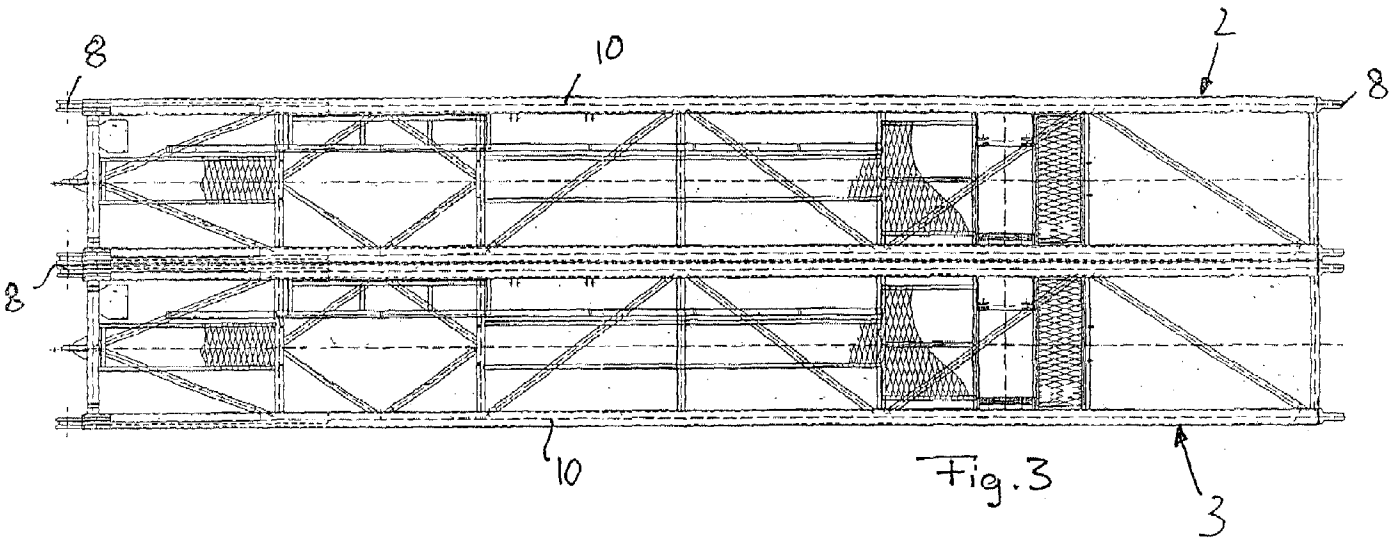
FIG. 3: a side view of the boom parts of the crane boom of FIG. 1 packed together and inserted into one another for transport.
Figure 6:
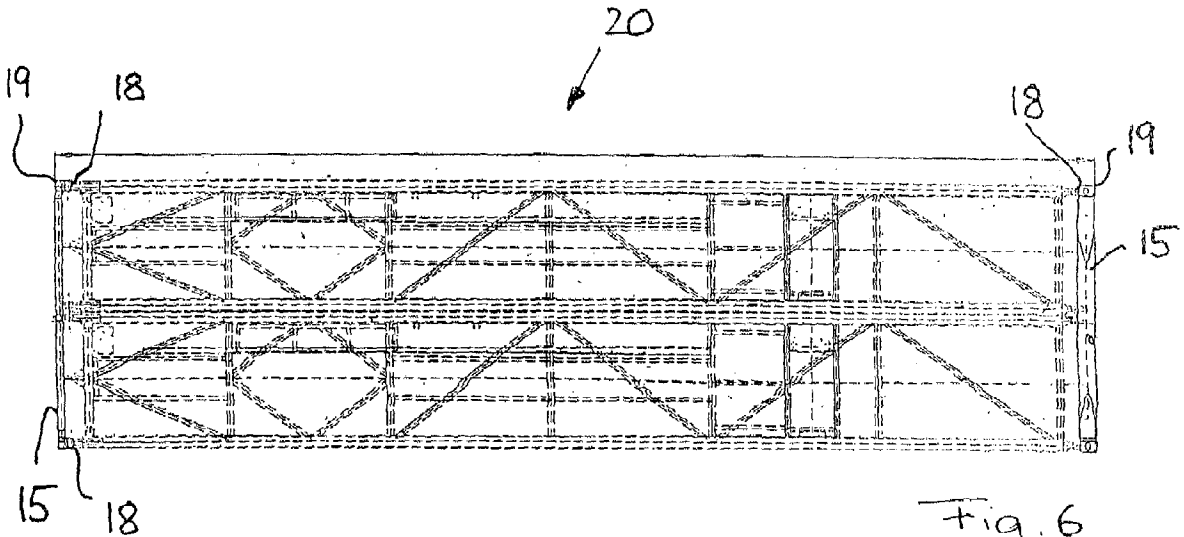
FIG. 6: a side view of the boom parts of the crane boom packed together and pushed into one another for transport similar to FIG. 3 with attached transport frames.

The transport frames 15 in addition have outwardly disposed connectors 19 which correspond in their arrangement and in their dimensions to the connectors of standardized containers. If the transport frames 15 are mounted to the packet of boom parts 2 to 7 consisting of the boom parts 2 and 3 disposed over one another and the boom parts 4 to 7 inserted therein in accordance with FIG. 3, a self-supporting, wall-free container unit is provided which can be stacked with other standardized and commercial containers. The transport frames form the external connectors onto which and under which the further containers can be stacked.

On the assembly for transport, the following procedure is possible: first, one of the transport frames 15 can be placed on the ground. The two boom parts 2 and 3 are put on perpendicularly by a crane and are bolted to the connection elements 18 of the transport frames 15 in the lower region. Then, the introduction of the further boom parts 4 to 7 into the two boom parts 2 and 3 likewise takes place perpendicularly from above into the respectively corresponding position where supports and/or fastening means are also present so that the boom parts 4 to 7 are centered and fastened in the boom parts 2 and 3 for transport. Then, the second transport frame 15 is mounted onto the top end of the boom parts 2 and 3, for which purpose the former is in turn bolted to the coupling pieces 8 of the boom parts 2 and 3.

The boom parts 4 to 7 of the crane boom do not necessarily have to be assembled with the transport frames 15 to form a container unit for transport. For the transport only from one building site to the next, the boom parts can advantageously also be loaded onto commercial trailers in the condition pushed into one another, with the reduction of the transport volume by the nesting of the boom parts also representing a substantial, cost-reducing advantage here.

Figure 7:
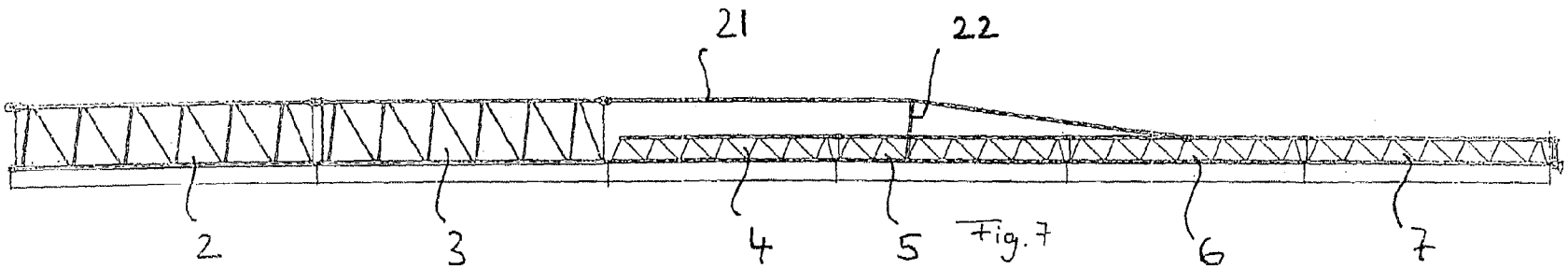
FIG. 7: a side view of a crane boom for a tower crane in accordance with an alternative embodiment of the invention in which the guying of the boom parts with smaller cross-sections has an additional guy strut.
Figure 9:
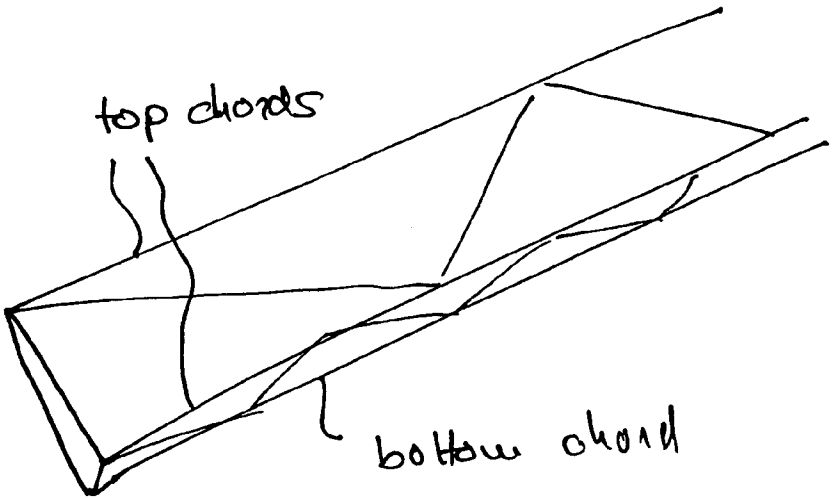
FIG. 9 a perspective view of the crane boom illustrated in FIG. 8.
Figure 8:
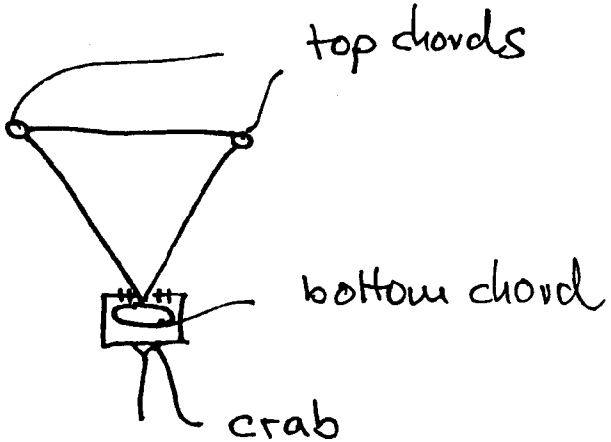
FIG. 8 an end view of a crane boom having two top chords and only one bottom chord, with a crab using the bottom chord as a runway.

As FIG. 1 shows, the outer boom parts 4 to 7 with smaller cross-sections can be guyed to the inner boom parts 2, 3 by a guying 21. This can also be guided over a guying block 22, as FIG. 7 shows.

The invention claimed is:

1. A crane boom for transport as container freight, comprising a plurality of boom parts (2-7) which can be assembled into the crane boom, each said boom part (2-7) have coupling pieces (8) at a front face end thereof for coupling together of the respective boom parts (2-7), the boom parts (2-7) each having at least one bottom chord (9, 13) structured and arranged such that when placed next to one another, the bottom chords (9, 13) of the respective boom parts (2-7) together form a continuous runway free of offset and faults for a crab, and at least two of the boom parts (2, 7) having different cross-sections and dimensions from one another, such that at least one (4-7) of the boom parts (2-7) is structured and arranged to be telescopically retracted into at least one other boom part (2,3) for transport as container freight in the state of being telescopically retracted into one another.

2. A crane boom in accordance with claim 1, wherein the boom parts (2-7) pushed into one another are dimensioned and made such that, in the state of the boom parts (2-7) pushed into one another, at least one of the boom parts (2, 3) can be assembled with its coupling pieces (8) at the face end to form a container unit (20) with a pair of transport frames (15) which each have container connectors (19) compatible with standard containers.

3. A crane boom in accordance with claim 2, wherein all the boom parts (2 to 7) each have two bottom chords (9, 13) made with identical track measurements.

4. A crane boom in accordance with claim 2, wherein all the boom parts (2-7) each have only one bottom chord and a plurality of top chords which are arranged in different track widths from one another.

5. A crane boom in accordance with claim 4, wherein a boom part (2,3) with larger cross-section and two boom parts (4, 5; 6, 7) with smaller cross-sections are structured and arranged with respect to one another, such that when the two boom parts (4,5; 6,7) of smaller cross-section are telescoped into the boom part (2, 3) with larger cross-section, the boom parts (4,5; 6,7) of smaller cross-section are situated adjacent one another therein.

6. A crane boom in accordance with claim 1, wherein all the boom parts (2 to 7) each have two bottom chords (9,13) made with identical track measurements.

7. A crane boom in accordance with claim 1, wherein all the boom parts (2-7) each have only one bottom chord and a plurality of top chords which are arranged in different track widths from one another.

8. A crane boom in accordance with claim 4, wherein a boom part (2,3) with larger cross-section and two boom parts (4, 5; 6, 7) with smaller cross-sections are structured and arranged with respect to one another, such that when the two boom parts (4,5; 6,7) of smaller cross-section are telescoped into the boom part (2, 3) with larger cross-section, the boom parts (4,5; 6,7) of smaller cross-section are situated adjacent one another therein.

9. A crane boom in accordance with claim 1, wherein a boom part (2,3) with larger cross-section and two boom parts (4, 5; 6, 7) with smaller cross-sections are structured and arranged with respect to one another, such that when the two boom parts (4,5; 6,7) of smaller cross-section are telescoped into the boom part (2, 3) with larger cross-section, the boom parts (4,5; 6,7) of smaller cross-section are situated adjacent one another therein.

10. A crane boom in accordance with claim 1, wherein at least one boom part (4, 5, 6, 7) is made as a three-chord carrier and at least one boom part (2, 3) has at least four longitudinal chords (9,10).

11. A crane boom in accordance with claim 1, wherein the at least one boom part (2, 3) with the at least four longitudinal chords (9, 10) has two lateral diagonal bracings (11) which are arranged spread open in V shape from the bottom chords (9) to the top chords (10).

12. A crane boom in accordance with claim 1, wherein two boom parts (2, 3) identical in cross-section with at least four longitudinal chords (9, 10) and at least two boom parts (4-7) identical in cross-section and each made as three-chord carriers are provided.

13. A crane boom in accordance with claim 1, wherein boom parts (4-7) arranged toward a boom tip are guyed toward a lower end of the boom by a guying (21) at a bottom or lower boom part(2, 3).

14. A crane boom in accordance with claim 1, wherein fastening means are provided for the fastening of the boom parts (4-7) with smaller cross-sections pushed into a boom part (2, 3) with a larger cross-section to the boom part (2, 3) with a larger cross-section.

15. A crane boom in accordance with claim 1, wherein said boom parts (2-7) having different cross-section each have differing number of top chords (14,10) and/or differing distance between the top chord (14, 10) and bottom chord(s)(9, 13), from one another.

16. The combination of a crane boom for transport as container freight, comprising a plurality of boom parts (2-7) which can be assembled into the crane boom, each said boom part (2-7) have coupling pieces (8) at a front face end thereof for coupling together of the respective boom parts (2-7), the boom parts (2-7) each having at least one bottom chord (9, 13) structured and arranged such that when placed next to one another, the bottom chords (9, 13) of the respective boom parts (2-7) together form a continuous runway free of offset and faults for a crab, and at least two of the boom parts (2, 7) having different cross-sections and dimensions from one another, such that at least one (4-7) of the boom parts (2-7) is structured and arranged to be telescopically retracted into at least one other boom part (2,3) for transport as container freight in the state of being telescopically retracted into one another, and transport apparatus for the transport of the boom parts (2-7) of the crane boom (1), as container freight, the transport apparatus having a pair of transport frames (15) which each have connection elements (18) for connection to the face end coupling pieces (8) of a boom part (2, 3) and container connectors (19) compatible with standard containers by which the transport frames (15) can be stacked with standard containers in the state attached to the boom part (2, 3).

17. The combination in accordance with claim 16, wherein the transport frames (15) each have two sets of connection elements (18) arranged next to one another for connection to the face end coupling pieces (8) of two boom parts (2, 3) arranged longitudinally next to or on one another.

18. The combination in accordance with claim 16, wherein each transport frame (15) has four frame limbs (16) assembled to form a closed rigid section as well as at least one diagonal strut (17).

19. The combination in accordance with claim 16, wherein the transport frames (15) are each mounted at a face end to at least one boom part.

20. The combination in accordance with claim 19, wherein the transport frames (15) are mounted at the face ends of two boom parts (2,3) arranged next to one another.

* * * * *